US011447385B2

(12) United States Patent
Chaloupka

(10) Patent No.: US 11,447,385 B2
(45) Date of Patent: Sep. 20, 2022

(54) DISPOSABLE BEVERAGE DISPENSER

(71) Applicant: Tap 3 Innovations, LLC, Sonoma, CA (US)

(72) Inventor: Hynek Chaloupka, Mikulov (CZ)

( * ) Notice: Subject to any disclaimer, the term of this patent is extended or adjusted under 35 U.S.C. 154(b) by 0 days.

(21) Appl. No.: 17/027,281

(22) Filed: Sep. 21, 2020

(65) Prior Publication Data

US 2021/0087046 A1 Mar. 25, 2021

Related U.S. Application Data

(60) Provisional application No. 62/903,203, filed on Sep. 20, 2019.

(51) Int. Cl.
*B67D 3/00* (2006.01)
*B65D 77/06* (2006.01)

(52) U.S. Cl.
CPC ..... *B67D 3/0067* (2013.01); *B65D 77/067* (2013.01); *B67D 3/0032* (2013.01); *B67D 2210/00097* (2013.01); *B67D 2210/00128* (2013.01)

(58) Field of Classification Search
CPC ..... B67D 3/0067; B67D 3/0032; B67D 2210/00097; B67D 2210/00128; B65D 77/067; B65D 5/46024; B65D 46/008; B65D 5/46192; B65D 2571/00512; A45C 13/26; B60N 3/02
USPC ..... 222/105, 129, 135, 94; 229/117.09, 229/117.13–117.15, 117.22–117.25
See application file for complete search history.

(56) References Cited

U.S. PATENT DOCUMENTS 5,186,359 A * 2/1993 Brown ..... B65D 5/48014 222/1
5,826,752 A * 10/1998 Latimer ..... B65D 77/065 222/105
6,755,324 B2 * 6/2004 Geshay ..... B65D 77/067 222/1
2012/0324700 A1 * 12/2012 Thomason ..... B65D 77/067 29/428

* cited by examiner

*Primary Examiner* — Vishal Pancholi
*Assistant Examiner* — Robert K Nichols, II
(74) *Attorney, Agent, or Firm* — Legends Law Group, PLLC; Stephen H. Bean, Esq

(57) ABSTRACT

A novel disposable beverage dispenser is provided. The present invention provides a beverage dispenser that allows a user to easily serve several bagged beverages from a single container that is more convenient, presentable and pleasing for use in parties, meetings, and other social gatherings. The invention is particularly suited to serving wine and spirits. The invention presents multiple dispensing pockets and corresponding tap configurations for bagged beverages in a single, easy to carry container.

2 Claims, 6 Drawing Sheets

DISPOSABLE BEVERAGE DISPENSER

FIELD OF THE INVENTION

This invention relates to a disposable beverage dispenser. In particular, the invention provides a novel dispenser that allows a user to easily serve several bagged beverages from the same package. The present invention is particularly suited to serving wine, but it is also useful for other types of liquid beverages. The dispenser is portable and has a low cost of manufacturing. The present invention allows a party or social gathering host to conveniently offer two or more beverages from a multi-tapped dispenser in one easy to carry environmentally friendly package and without the worry of purchasing or carrying multiple heavy bottles, broken bottles, stained bottle labels, or unsightly beverage spills.

BACKGROUND OF THE INVENTION

A common problem in hosting parties, meetings, or social gatherings is how to deliver multiple beverage choices with a minimum of inconvenience and cost. The host of such gatherings often desires to provide a number of different beverages to suit their guests' varied tastes and preferences without excessive cost, carrying inconvenience, hassle or trouble. It can be difficult to do so when serving, for example, a variety of wines, cocktails or Ready to Drink ("RTD") spirits. Wines and spirits are typically packaged singularly in large bottle formats so many different bottles are required in order to serve a variety of wines or cocktails. Additionally, these bottles often require a tool for opening (corkscrew) that can be difficult to use by a large segment of the population, especially in a house party environment. Wines and spirits are also stored in large bottles that can break and that are difficult to pour without making a mess. This can be inconvenient when shopping, transporting, and serving the wines and spirits. One solution known in the art is to provide wine or spirits in a boxed configuration. This is commonly referred to as bag-in-box packaging.

There are numerous examples of bag-in-box configurations for dispensing beverages. For example, United States U.S. Pat. No. 7,770,756 to Cook et al. discloses a bulk container assembly for delivering liquids or powders. The assembly is disposable and can be used to dispense liquids without requiring the catering company to return to the site to collect and dispose of empty bottles. The Cook disclosure is a single-use box that is configured to dispense one liquid at a time. Another example of a portable, single-liquid dispenser is the device taught by Lips in U.S. Pat. No. 8,162,180. This device is a single-liquid dispenser particularly suited for delivery of volatile liquids, such as gasoline and other petroleum-based flammables. The container is collapsible when empty and is therefore well-suited for storage in the trunk of a car. Like the Cook disclosure, this also is a single-liquid dispenser. Yet another example is the disclosure in U.S. Pat. No. 8,672,184 to Edwards. This device is a bag-in-box arrangement having a locating panel for a tap. The locating panel assists the user in breaking through the tap perforation in the outer box and pulling the tap through the perforation for use. This arrangement is also a single-beverage arrangement.

U.S. Pat. No. 8,857,666 to O'Keefe, Jr. is directed to a wine dispensing system for delivering numerous wines from multiple tapped boxes. Each box is an individual container with its own wine. The boxes are tapped and the wine is directed upward to a central pouring bar located above the boxes. The pouring bar allows display of wine bottles associated with each box of tapped wine. Although this device is a multiple-tapped arrangement that teaches delivery of more than one wine from a bag-in-box arrangement, there is no disclosure of a single box having multiple compartments for various wines or spirits, each delivered through a separate tap within the same box. Furthermore, the wine dispenser taught by O'Keefe Jr. is not a disposable configuration.

Likewise, U.S. Pat. No. 10,196,255 to Henriquez discloses a portable wine dispenser for delivering bagged wines up through hoses to a central pouring bar. In this reference, the multiple wine delivery is taught without reference to boxes for storing the wine bags. There is also no mention of a single box being used for delivery of multiple beverages in a tapped arrangement. Further, the dispenser taught by Henriquez is not disposable.

There exists a need in the art for a beverage dispenser that delivers two or more beverages in a tapped arrangement contained within a single disposable unit. There further exists a need for a portable dispenser of two or more beverages that is not costly to manufacture and is disposable. There exists further a need in the art for a disposable multiple beverage dispense that is convenient to carry. Yet further, there exists a need in the art for a device that allows for convenient delivery of various beverages, including wines and spirits, for mixing. There also exists a need in the art for a boxed arrangement of wines where the purchaser can be presented with a variety of wines for purchase in the same single article.

SUMMARY OF THE INVENTION

A disposable multitap beverage dispenser is provided herein. The dispenser is configured as a single support container having at least two inner pockets, a handle, and tap perforations located near a bottom portion of and corresponding to each of the inner pockets. Further, the dispenser has beverage bags configured to be inserted into each pocket, with each bag having a tap and shield. The tap and shield of each bag are configured to be extended outward from the inside of the dispenser through the perforations. After being passed through the perforations, the tap and shield are secured on the outside of the dispenser such that a user can depress or push the tap and the shield will inhibit the tap from being pushed into the dispenser. The dispenser may also have pocket dividers to add additional strength to the unit during operation. The pocket dividers can be easily flattened for minimal disposal space when the beverage bags are completely used up and the dispenser is to be discarded.

Figure 1:
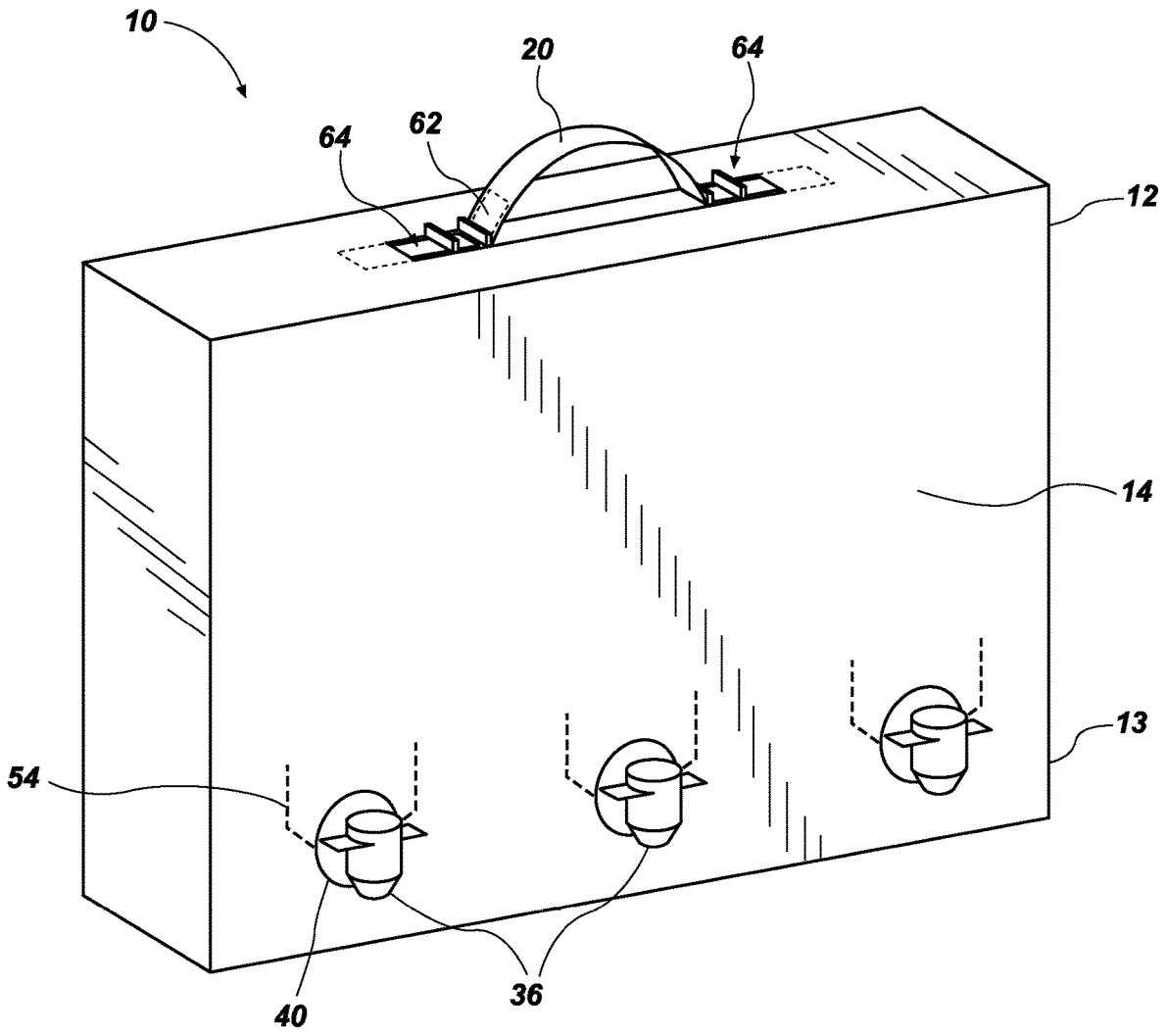
FIG. 1 illustrates a perspective view of one embodiment of the beverage dispenser of the present invention.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION OF THE INVENTION

Reference will now be made in detail to the presently preferred embodiments of the invention. There are also representative examples of the invention illustrated in the accompanying drawings. Throughout the following detailed description, the same reference numeral refers to the same elements in all figures.

The present invention provides a disposable beverage dispenser that presents two or more bagged beverages in a single container arrangement. The invention is particularly suited for dispensing wines at parties, meetings, or social gatherings. In one embodiment, the invention provides for a single disposable container that supports three different wines in a tapped arrangement. The container of the present invention is collapsible and can be manufactured at low cost.

Figure 2:
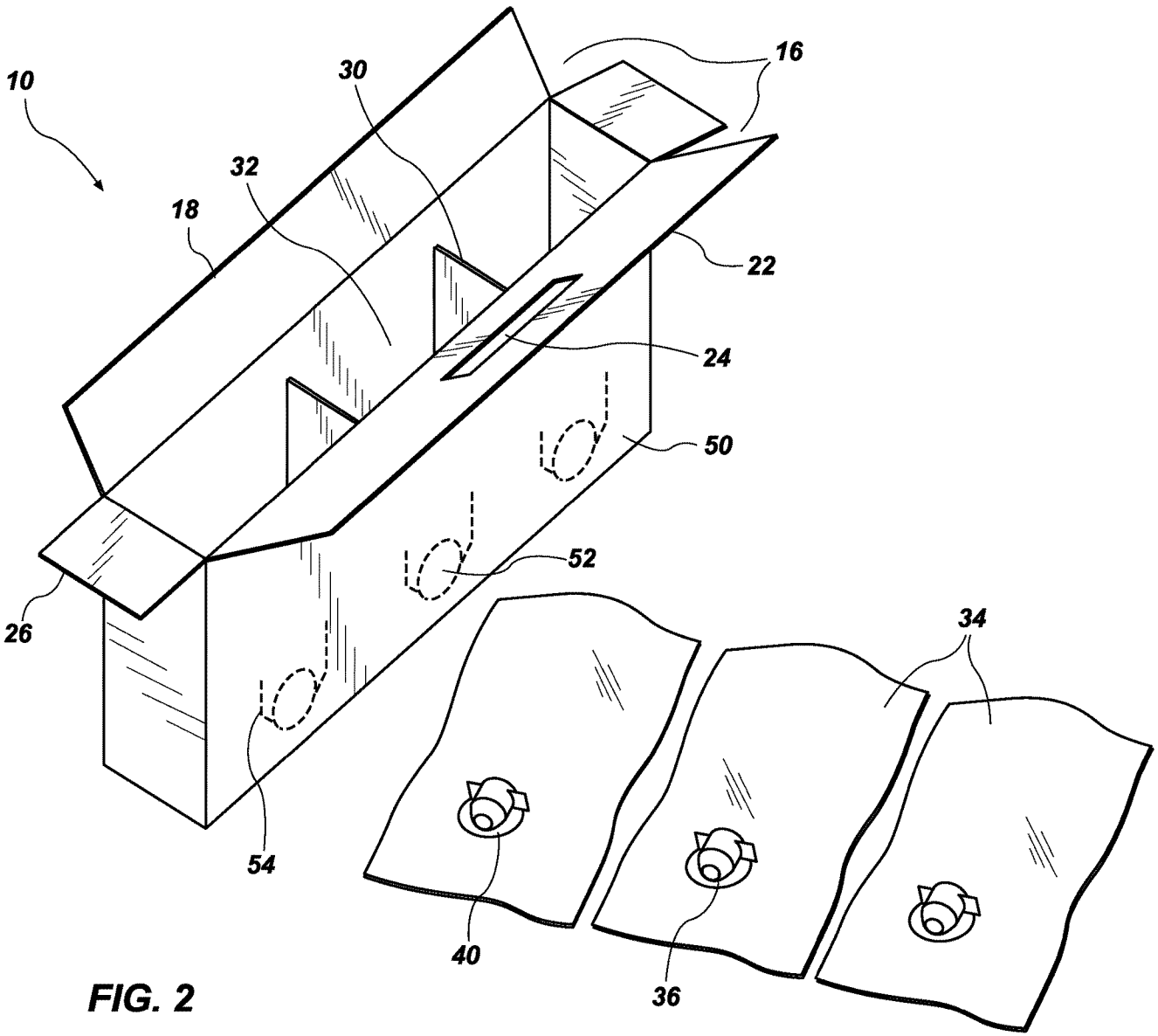
FIG. 2 illustrates a perspective view of the beverage dispenser of the present invention in an opened and empty arrangement.
Figure 3:
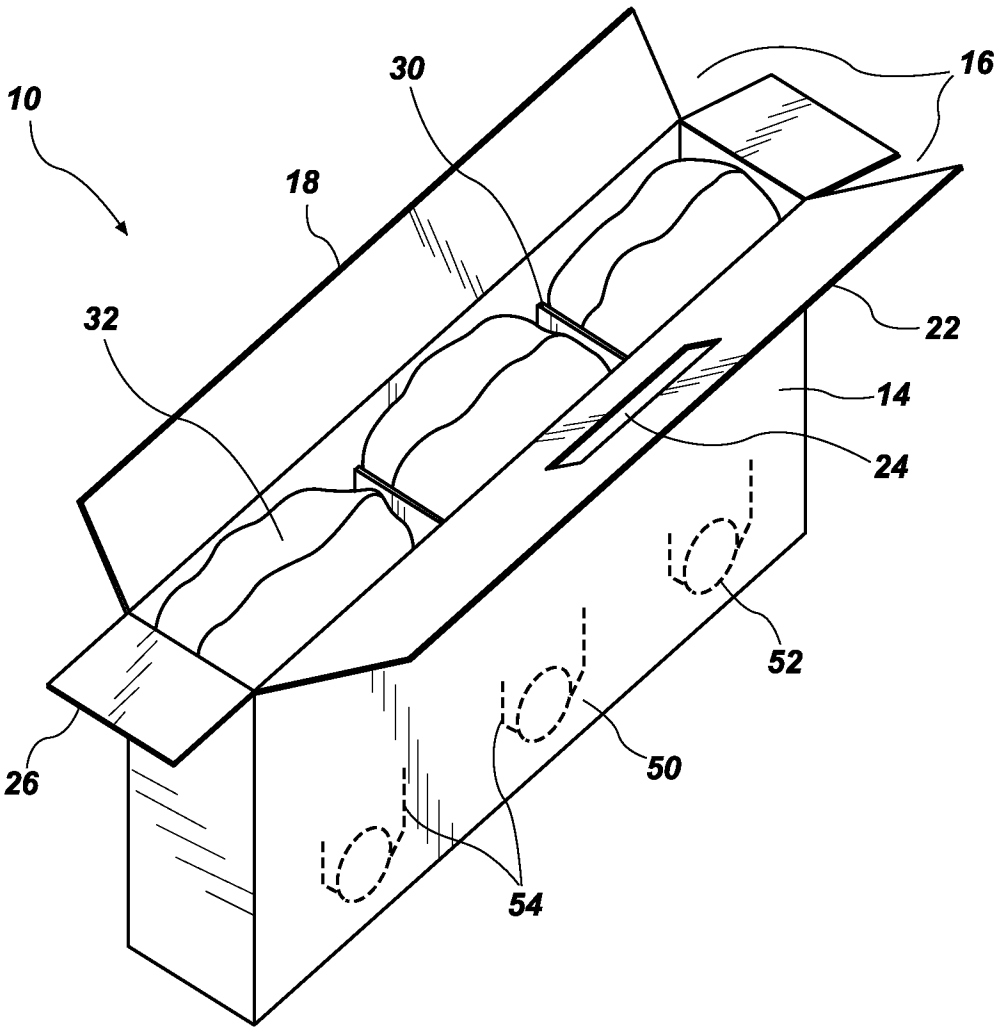
FIG. 3 illustrates a perspective view of the beverage dispenser of the present invention in an open and loaded arrangement.
Figure 4:
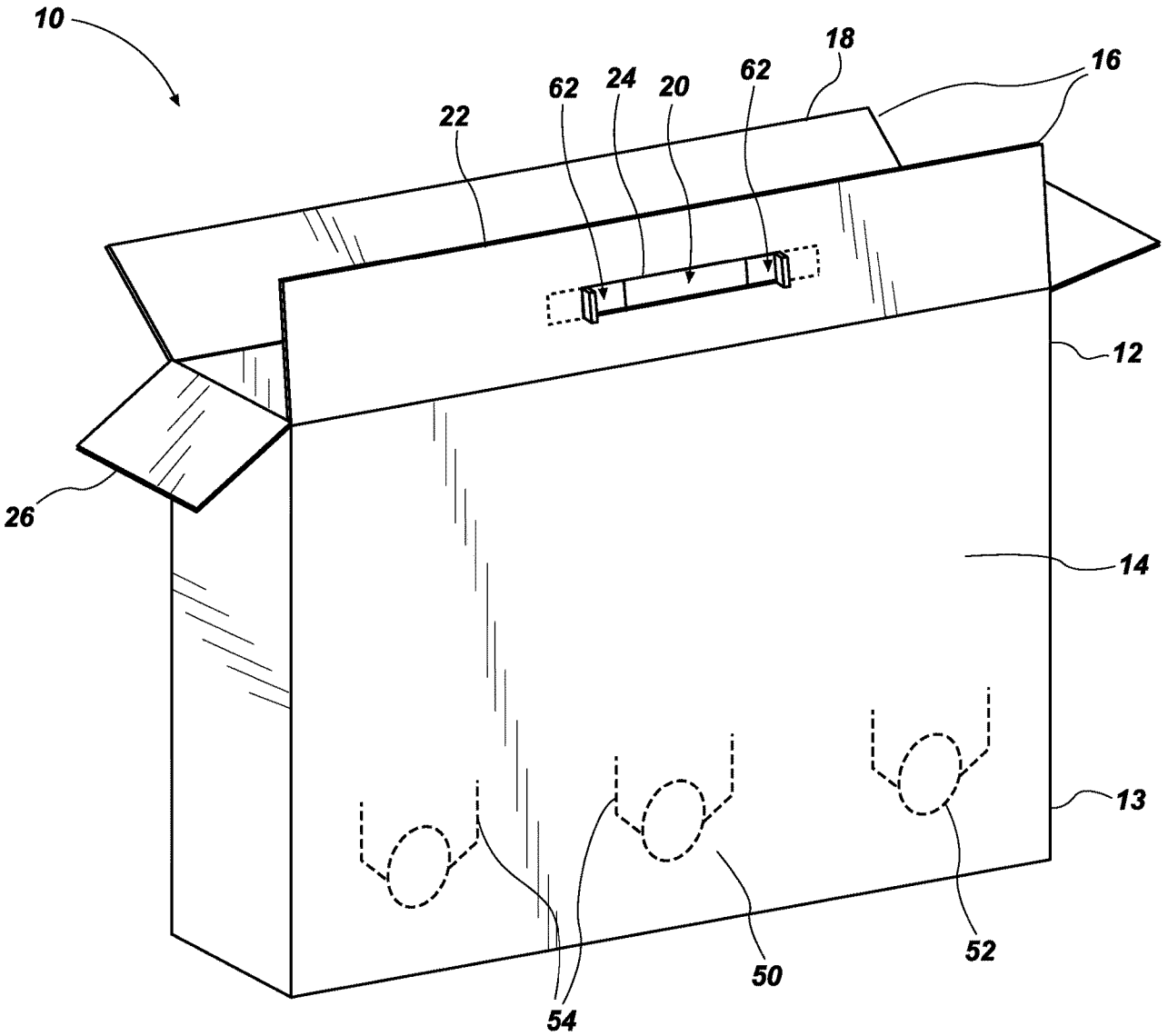
FIG. 4 illustrates a perspective view of the beverage dispenser of the present invention in an open arrangement with the perforations intact.
Figure 5:
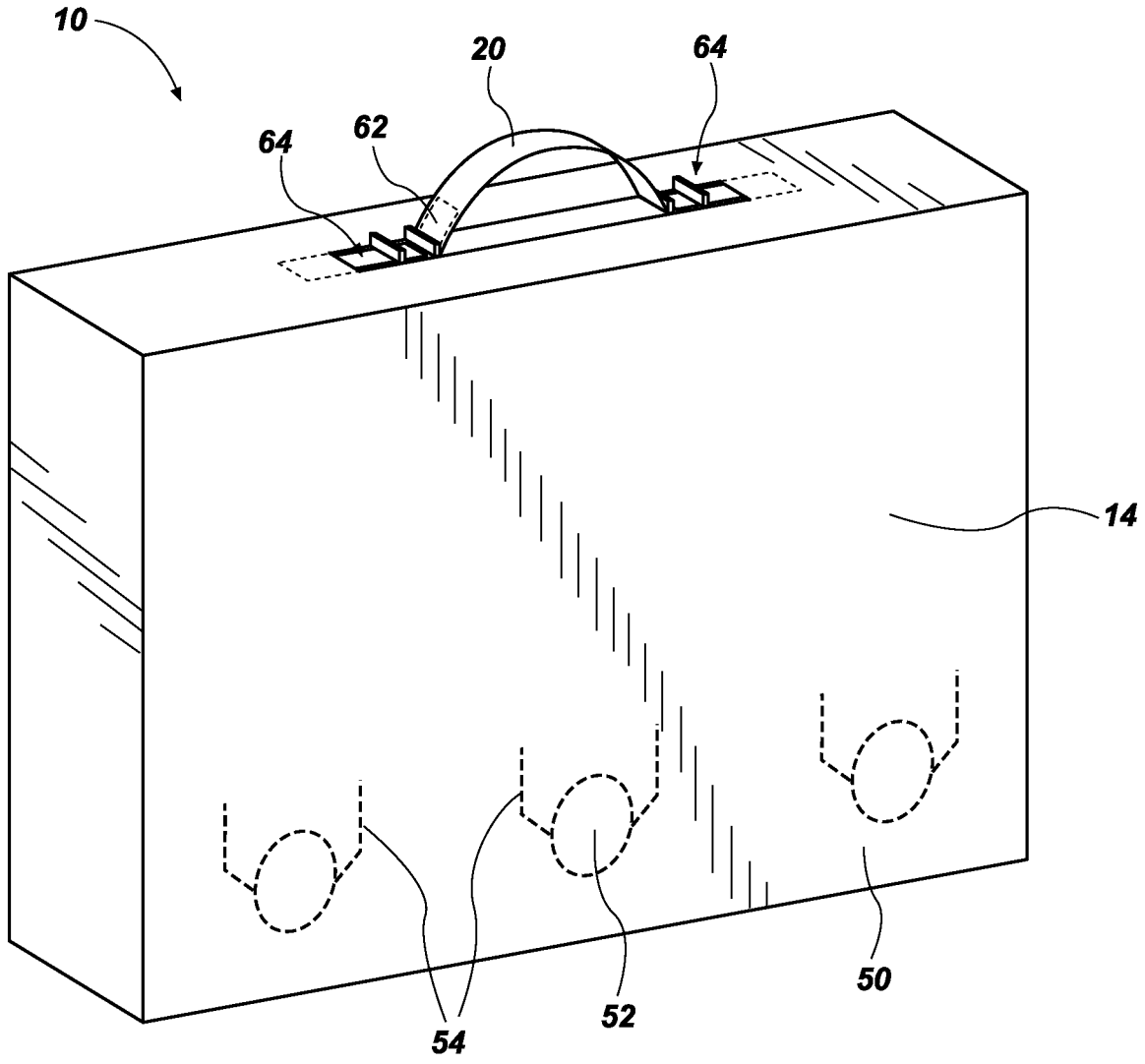
FIG. 5 illustrates a perspective view of the beverage dispenser of the present invention in a closed arrangement with the perforations intact.

FIG. 1 shows one embodiment of a disposable beverage dispenser of the present invention. There is a container 10 that provides a supporting structure for enclosing and presenting the bagged beverages 34. Container 10 has top and bottom portions 12 and 13 and front face 14. Container 10 is configured from a single sheet of cardboard and arranged such that it forms a box-like shape when constructed in standing form. Further, as shown in FIGS. 2-4, there are longitudinal flaps 16 at top portion 12 of container 10. In one embodiment of the invention, front flap 22 comprises a receiving hole 24 that is configured to receive a carrying handle 20. There is also a longitudinal back flap 18 upon which handle 20 can be fixedly attached. Transverse flaps 26 are also provided at top portion 12 of container 10. In one embodiment of the present invention, container 10 can be closed by inwardly folding transverse flaps 26, followed by folding down back flap 18 with carrying handle 20. Front flap 22 is then folded down on top of back flap 18 such that carrying handle 20 protrudes through receiving hole 24.

In another embodiment of the present invention, carrying handle 20 is configured with tabs 62 that are moveable between positions of being flush with handle 20 and lying flat against the surface of front flap 22 at opposing edges of receiving hole 24. Opposing edges of receiving hole 24 of front flap 22 can be configured with sliders 64 that are moveable between an open and closed position, with open being a position where the tab is biased away from handle 20 and closed being a position where the tab is flush against handle 20 and covering tabs 62. In this manner, handle 20 can be inserted through receiving hole 24 and locked in place against front flap 22 such that container 10 can be carried about and set down without the longitudinal and transverse flaps opening up and without handle 20 inadvertently slipping into a flattened position.

The present invention further provides at least one divider 30 within container 10 to compartmentalize said container into a multi-pocketed device. In a preferred embodiment of the invention there are at least two such dividers. Dispensing pockets 32 are defined by dividers 30 and the walls of container 10. The pockets are configured to accept beverage bags 34. The bags 34 have dispensing taps 36 and support shields 40 located at a lower end, with the taps and shields corresponding in location to tap perforations 50 placed on front face 14 at a lower portion 13 of container 10. Tap perforations 50 comprise a circular perforation 52 and two tab lines 54 that extend vertically upward from opposing sides of circular perforation 52.

As shown in FIG. 3, container 10 is configured such that beverage bags 34 are inserted into dispensing pockets 32, with the dispensing taps 36 located in a lower portion 13 of front face 14. Dispensing tabs 36 should align with tap perforations 50 such that the taps can be pulled outward from container 10 and arranged to be securely positioned in a serving arrangement. To accomplish the serving arrangement, a user would insert his hand between beverage bag 34 and circular perforation 52 of front face 14 and poke his finger against circular perforation 52, thereby causing the perforation to break and dislodging the circular segment of container 10. The user would then push or pull lightly against tab lines 54 to bend the lines either inward or outward from front face 14. After accomplishing this, the user can then slip dispensing tap 36 and support shield 40 through the circular perforation hole and then readjust tab lines 54 to close back against the underside of support shield 40. According to the present invention, tab lines 54 are spaced a slight distance from the opposing edges of circular perforation 52 such that a slightly wider space is provided for support shield 40 to be slipped through the circular hole and then slid down on a bottom portion of said hole. In this manner, shield 40 acts to prevent both the shield and dispensing tap 36 from slipping back into container 10 during the dispensing of the beverages.

Figure 6:
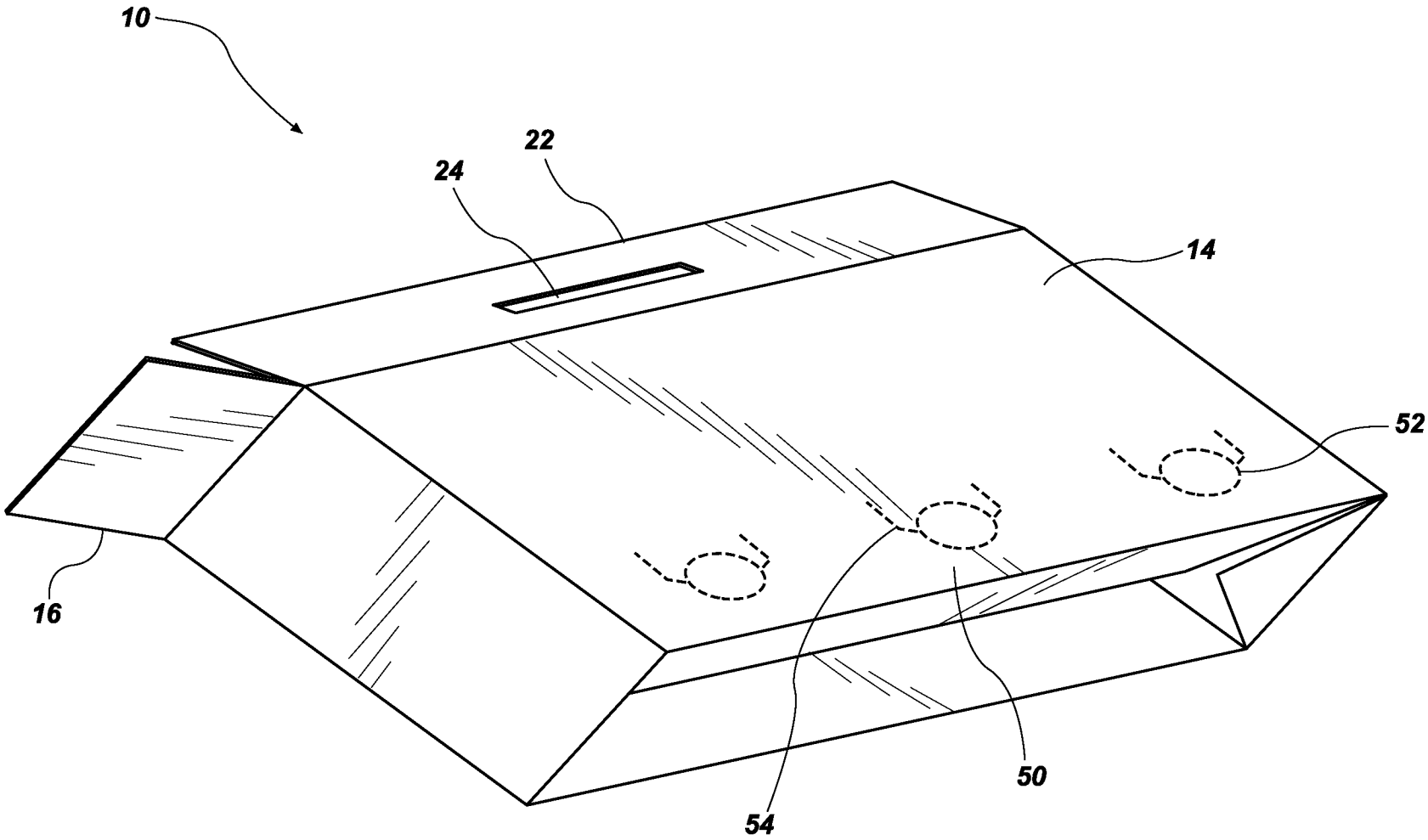
FIG. 6 illustrates a perspective view of the beverage dispenser of the present invention in a partially collapsed arrangement.

FIG. 6 shows container 10 in a partially collapsed state. One advantage to the collapsibility of the present device is that it is not only more efficient to manufacture and ship in bulk but it is also easier to clean and dispose of multiple dispensing devices at the same time. The present invention allows multiple beverages, such as wines, to be dispensed from the same disposable container. It also is more attractive to display in a store and more convenient for beverage purchasers who wish to easily and quickly purchase two or more beverages in a single boxed arrangement. Another advantage of the present invention is that it eliminates the clutter and untidiness of multiple boxed containers becoming dislodged and unarranged during use. Thus, the purchaser has not only the convenience of easier shopping for two or more beverages but also the added convenience of more ease in maintaining a clean and slightly appearance at parties, meetings, and other social gatherings.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A disposable multitap beverage dispenser comprising:

a single support container comprising at least two inner pockets, a collapsible handle comprising moveable handle tabs, and tap perforations located near a bottom portion of and corresponding to each of said inner pockets;

beverage bags configured for insertion into said inner pockets, each beverage bag comprising a tap and a shield configured for being passed through said tap perforations and securely arranged on the outside of said container; and sliders configured for selective engagement with said moveable handle tabs to prevent said handle from slipping into a flattened position.

2. The beverage dispenser of claim 1 further comprising dividers to separate said beverage bags.

* * * * *